United States Patent [19]

Beaumont

[11] 4,328,695

[45] May 11, 1982

[54] PUNCH ADAPTOR FOR FOLDING MACHINE

[75] Inventor: Graham J. Beaumont, Sheffield, England

[73] Assignee: Keeton Sons & Co. Ltd., Sheffield, England

[21] Appl. No.: 147,424

[22] Filed: May 6, 1980

[30] Foreign Application Priority Data

May 16, 1979 [GB] United Kingdom ..... 7917002

[51] Int. Cl.[3] ..... B21D 7/06; B21D 37/00

[52] U.S. Cl. ..... 72/389; 72/404; 72/450

[58] Field of Search ..... 72/389, 386, 380, 319, 72/450, 404, 429; 270/444

[56] References Cited

U.S. PATENT DOCUMENTS 1,870,754 8/1932 Schulz ..... 493/444
3,552,179 1/1971 Kapustin ..... 72/389
4,079,617 3/1978 Whiting ..... 72/453.06
4,080,814 3/1978 Eaton ..... 72/389

FOREIGN PATENT DOCUMENTS 2614177 10/1976 Fed. Rep. of Germany ..... 72/319
985732 10/1965 United Kingdom .

*Primary Examiner*—Gene P. Crosby
*Attorney, Agent, or Firm*—Merriam, Marshall & Bicknell

[57] ABSTRACT

A folding machine has a pair of longitudinally extending forming members which in a rest position have horizontal co-planar upper surfaces 22 and 23. In use as a folding machine a holding tool (not shown) is supported on a holding bar 33 to hold a workpiece which is folded by swinging the forming members 15 and 16 upwardly and outwardly as shown. The folding machine is modified in accordance with the invention by the provision of a vertically guided horizontal platten 41 connected to the forming members by pivoted links 42 and 43 to enable the apparatus to operate a punch and die set 48. A fixed abutment 51 on the holding bar 33 operates the punch as the platten is raised.

3 Claims, 4 Drawing Figures

PUNCH ADAPTOR FOR FOLDING MACHINE

BACKGROUND OF THE INVENTION

The invention relates to folding machines and particularly to adaptors to make such machines suitable for use as punches.

A folding machine is described in U.K. Patent Specification No. 985,732 which comprises a pair of forming members mounted for pivotal movement in opposed directions about a common pivot axis from a rest position in which the upper surfaces of the forming members are co-planar to a folding position in which said upper surfaces are inclined to each other, and a holding tool located above said axis and moveable into contact with a sheet metal or other workpiece laid across the upper surfaces of the forming members in their rest position to provide a stationary fold guide during the folding operation.

It is also known to use a conventional press with a vertically moving horizontal platten for punching operations by inserting a punch and die set in the press and then operating the press which in turn operates the punch and die set. The folding machine described briefly above is not readily adaptable to punching operations because it does not have a vertically moveable horizontal platten. An object of the present invention is to adapt such a folding machine to make it suitable for use as a punch.

SUMMARY OF THE INVENTION

According to the present invention a folding machine of the kind comprising a pair of forming members mounted for pivotal movement in opposed directions about a common pivot axis from a rest position in which the upper surfaces of the forming members are co-planar to a folding position in which the said upper surfaces are inclined to each other is characterised by a horizontal platten arranged above the forming members and connected thereto so as to move vertically on pivotal movement of the forming members, a punch and die set on the platten and a stationary abutment for the punch above the platten.

Preferably the connection between the forming members and the platten comprises a first strut pivoted to a first forming member at a position outwardly of and below the pivot axis of the forming member and extending up to a pivoted connection with the platten and a second strut pivoted to the second forming member at a position outwardly of and below the pivot axis of the forming member and extending up to a pivoted connection with the platten.

Preferably the platten is provided with fixed vertical guides.

BRIEF DESCRIPTION OF THE DRAWINGS

An embodiment of the invention will now be described by way of example only with reference to the accompanying drawings in which.

DESCRIPTION OF PREFERRED EMBODIMENTS

Figure 1:
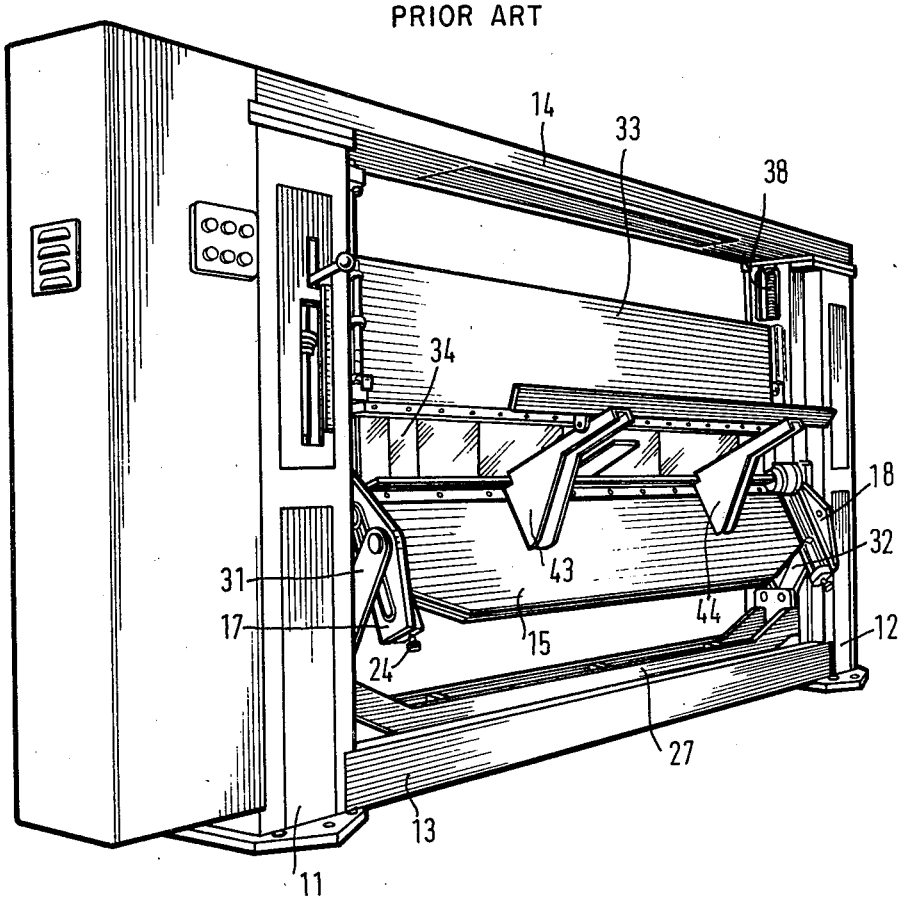
FIG. 1. PRIOR ART
FIG. 1 is a perspective view of the kind of folding machine to which the invention relates.
Figure 2:
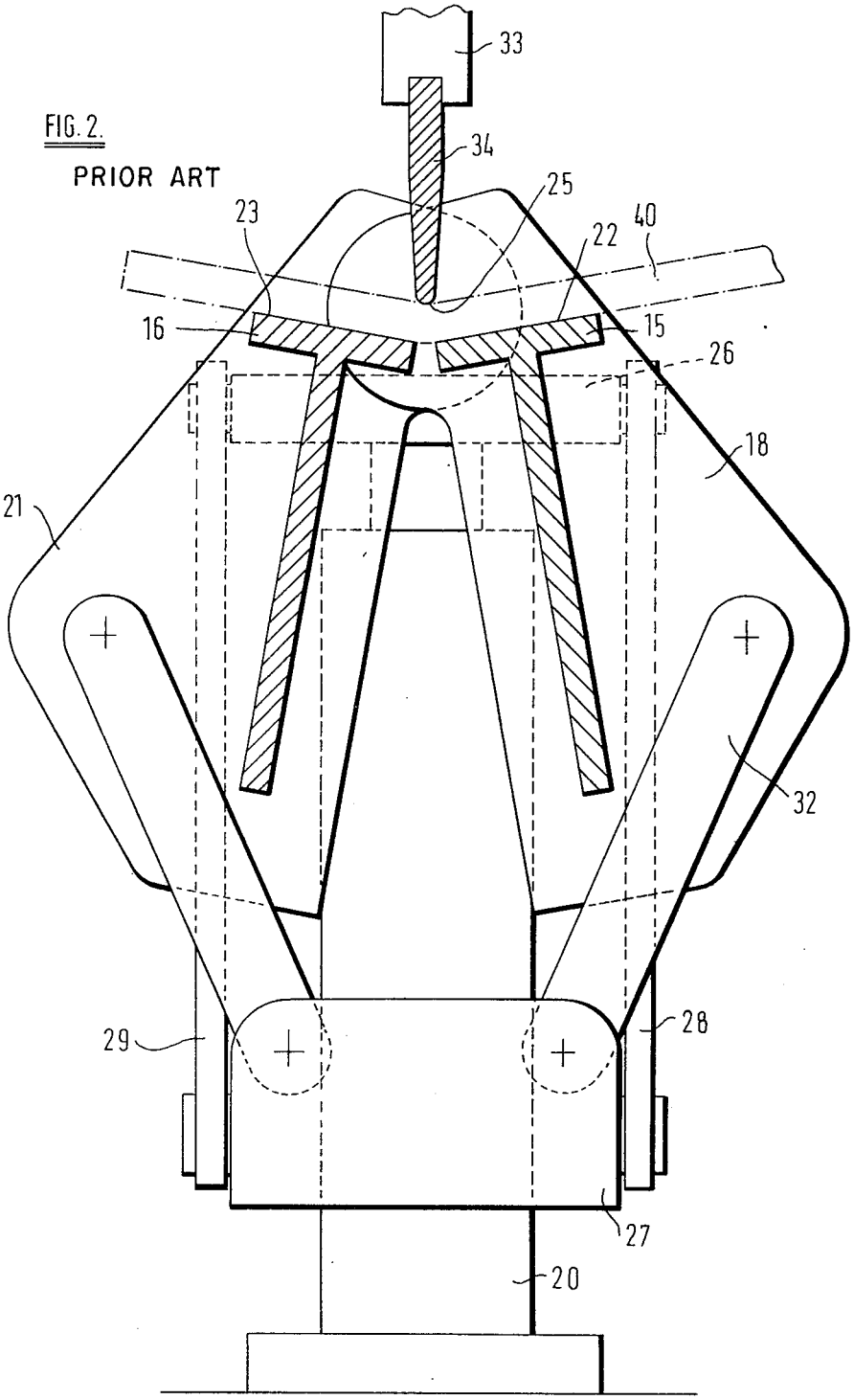
FIG. 2. PRIOR ART
FIG. 2 is a diagrammatic cross sectional view showing the basic operating parts of the machine of FIG. 1.

The folding machine shown in FIGS. 1 and 2 corresponds to the machine described in U.K. Patent Specification No. 985,732, the disclosure of which is incorporated herein by reference and for that reason only the basic features of the machine will be described herein. The machine comprises a fixed frame constituted by two upright end members 11 and 12, two transverse lower frame member 13 and a transverse upper frame member 14.

Two forming members 15 and 16 are each supported at each end on pivoting supports such as the supports 17 and 18 for the forming member 15. One pivoting support 21 for the forming member 16 is also shown in FIG. 2. The forming members have upper surfaces 22 and 23 respectively which in the rest position of the machine are in a common horizontal plane. The height of the forming members is adjustable on their pivoting supports by adjustment means such as the screw adjuster 24 for support 17 to allow the upper surfaces 22 and 23 in the rest position to be a required distance below the pivot axis 25 of the pivoting supports. In use, the forming members also pivot about this pivot axis.

Pivoting movement of the forming members is provided by two hydraulic cylinders, one in each upright end member and one of which is shown diagrammatically at 20 in FIG. 2. The fixed hydraulic cylinder 20 is arranged to lift a trunion 26 which in turn lifts a longitudinal lifting beam 27 by means of links 28 and 29. The lifting beam 27 extends from one upright end member to the other and can be raised or lowered by two similar mechanisms, one at each end. The lifting beam is connected by two pairs of struts such as 31 and 32 to the pivoting supports such as 17 and 18 so that raising of the lifting beam pivots the supports in an outward direction and correspondingly pivots the forming members 15 and 16 in an upward and outward direction. FIG. 1 and in particular FIG. 2 show a position in which some upward and outward pivoting action has occurred from the rest position.

The press also incorporates a holding bar 33 which extends between the two upright end members 11 and 12 and is adjustable in height by means of a threaded adjuster 38 operated from an electric motor (not shown). The holding bar 33 carries a holding tool 34 which, in the example of FIG. 1, is in the form of a number of short segments.

In use of the conventional machine thus far described, the holding bar and its holding tool are raised to allow a sheet of metal 40 to be inserted. The forming members are in their rest position with their upper surfaces 22 and 23 horizontal and in contact with each other. The height of the forming members is adjusted so that the upper surfaces 22 and 23 are below the pivot axis 25 by a distance equal to the thickness of the material to be formed plus the radius of curvature of the holding tool. A sheet of material is then positioned on the horizontal surfaces 22 and 23 with the required fold line immediately below the holding tool 34. The holding tool 34 is then lowered until its centre of curvature coincides with the pivot 25. In this position it is in contact with and holds the sheet to be formed. The hydraulic cylinders such as 20 are then pressurised to lift the lifting beam 27 and thereby swing the forming members upwardly and outwardly about their pivot axis 25. This action forms a bend in the workpiece.

The machine is equipped with adjustable stops and other controls to facilitate setting of the machine and to control the angle of the fold.

Figure 3:
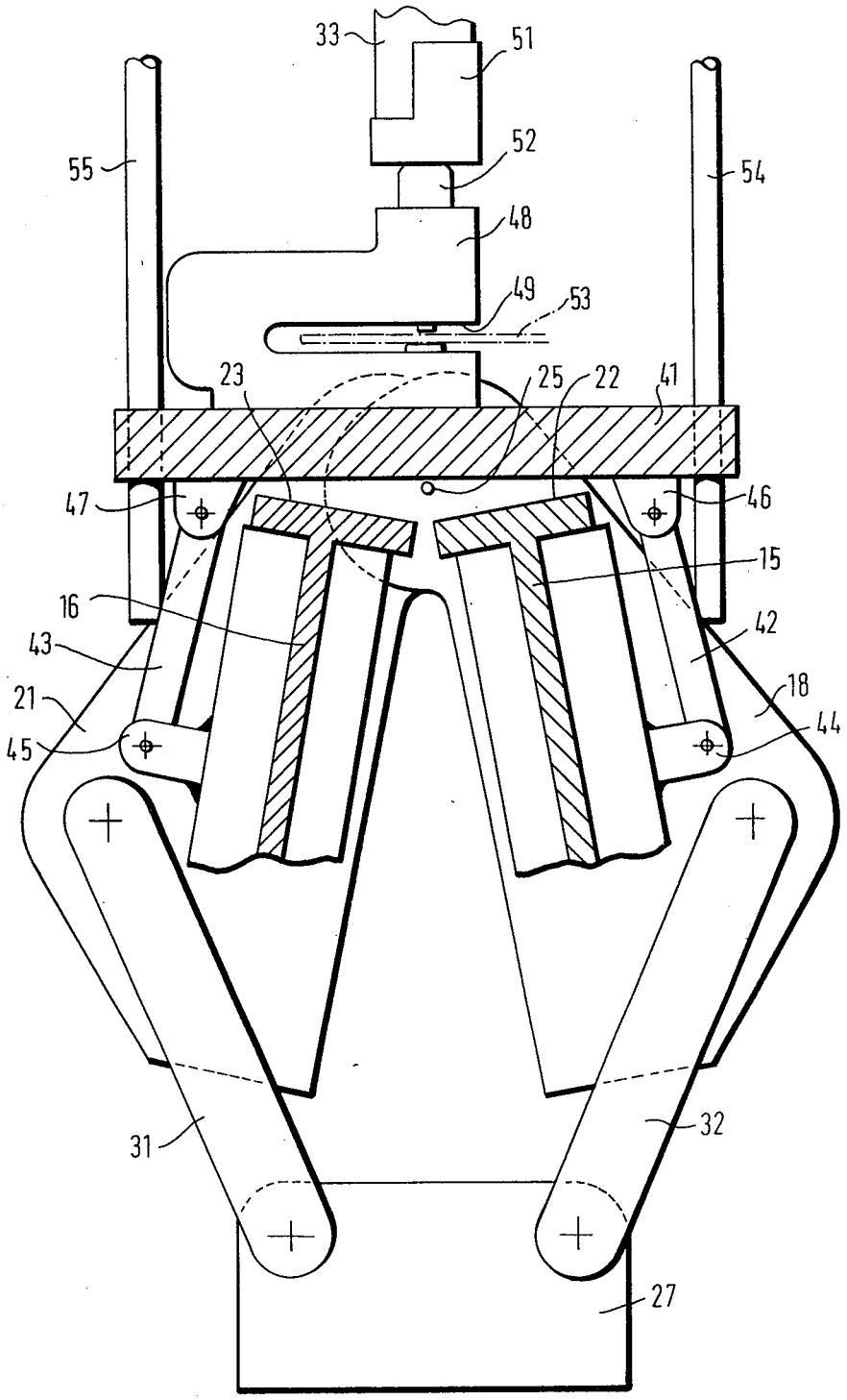
FIG. 3 is a diagrammatic cross section showing certain parts which are shown in FIG. 2 but also showing the addition of a platten and punch and die set according to the invention.

FIG. 3 shows the forming members 15 and 16, pivoting supports 18 and 21, lifting beam 27, struts such as 32 and holding bar 33 corresponding to the equivalent components shown in FIG. 2. However, in accordance with the invention, the machine is equipped with a horizontal platten 41 which is supported just clear of the forming members 15 and 16 by two links such as link 42 on one side and two further links such as link 43 on the other side. Each link is pivoted to a bracket 44 or 45 on the respective forming member and each bracket is at a position well below and outwardly of the pivotal axis 25 of the forming members. Links 42 and 43 are also pivotally connected to brackets 46 and 47 on the underside of the platten 41.

Four additional fixed vertical guides such as 54 and 55 are secured at their upper ends to the holding bar 33 to maintain the platten 41 in its horizontal condition.

A conventional punch and die set 48 with a slot 49 for engaging a workpiece is located on the platten 41. The hold down tool 34 of FIG. 1 is replaced by a punch abutment 51 and the punch and die set is in such a position that the punch 52 is directly below abutment 51.

Figure 4:
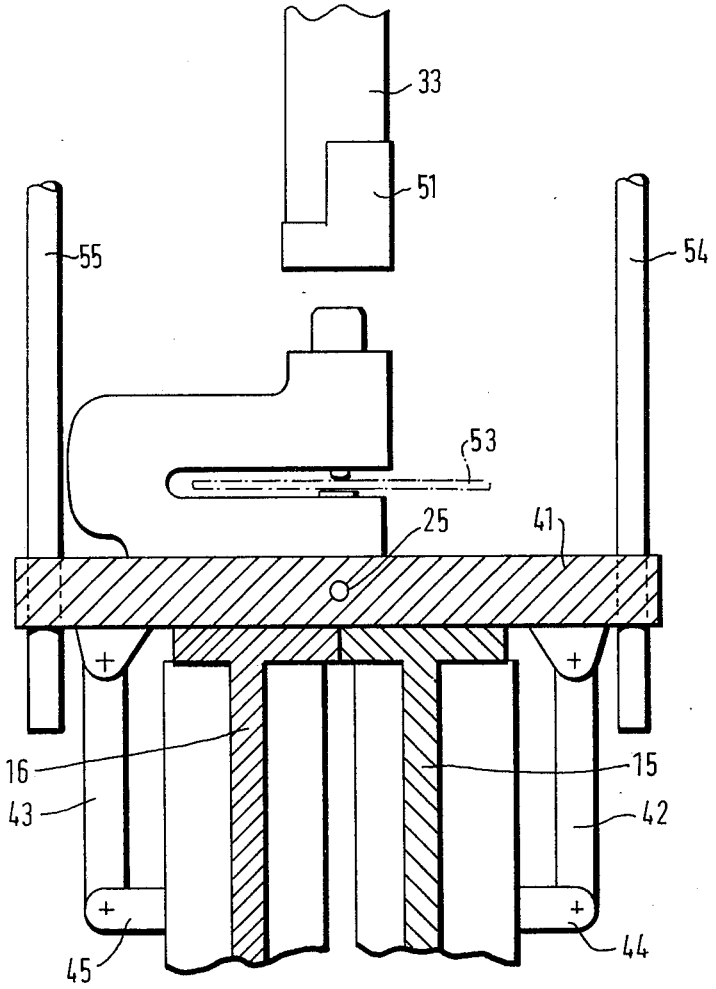
FIG. 4 is a view corresponding to FIG. 3 but showing the apparatus in the rest position.

The operation of the apparatus can best be seen by comparing FIGS. 3 and 4. In FIG. 4, the lifting beam 27 (not shown) is in its lowered position so that the forming members 15 and 16 are in the rest position with their upper surfaces horizontal. In order to perform a punching operation, a workpiece 53 is positioned in the opening 49 while the apparatus is in the rest position shown in FIG. 4. The hydraulic cylinders 20 (see FIG. 2) are then pressurised to move the forming members as shown in FIG. 3 and raise the platten until the punch 52 comes into contact with the abutment 51 as shown in FIG. 3. With a little additional lifting movement, the punch 52 is operated by the abutment 51 so that a hole is punched in the workpiece. The apparatus is then returned to the rest position shown in FIG. 4 at which point the workpiece can be removed.

In this way, the versatility of the folding machine is increased to enable it to perform punching operations by the addition of only a small number of easily removeable additional components. When it is desired to use the apparatus as a folding machine it is of course necessary to remove the platten 41 with its links 42 and 43 and the vertical guides 54 and 55. The abutment 51 is of course replaced by an appropriate holding tool.

Instead of using four lifting links such as 42 and 43, it would be possible to provide two spaced links for connection to one forming member and a single central link for the other forming member. It may even be possible to use only two such links if adequate additional vertical guides 54 and 55 are provided. As a further alternative to the links 42 and 43, an alternative form of linkage may be provided between the forming members and the platten. For example, the vertical load on the platten could be transferred directly by the outer edges of the upper surfaces of the forming members 15 and 16 resting on the underside of the platten 41.

I claim:

1. In a folding machine of the kind comprising a pair of forming members mounted for pivotal movement in opposed directions about a common pivot axis from a rest position in which the upper surfaces of the forming members are co-planar to a forming position in which the said upper surfaces are inclined to each other, the improvement which comprises a horizontal platten arranged above the forming members connection means operatively interconnecting the horizontal platten to the forming members so as to move said platten vertically on pivotal movement of the forming members, a punch and die set arranged on the platten and a stationary abutment for the punch above the platten.

2. A folding machine as claimed in claim 1 wherein the connection means between the forming members and the platten comprises a first strut pivoted to a first forming member at a position outwardly of and below the pivot axis of the forming member and extending up to a pivotal connection with the platten and a second strut pivoted to a second forming member at a position outwardly of and below the pivot axis of the forming member and extending up to a pivoted connection with the platten.

3. A folding machine as claimed in claim 1 wherein the platten is provided with fixed vertical guides independent of the connection to the forming members.

* * * * *